United States Patent [19]

Kirrmann

[11] Patent Number: 4,924,379

[45] Date of Patent: May 8, 1990

[54] MULTIPROCESSOR SYSTEM WITH SEVERAL PROCESSORS EQUIPPED WITH CACHE MEMORIES AND WITH A COMMON MEMORY

[75] Inventor: Hubert Kirrmann, Baden, Switzerland

[73] Assignee: BBC Brown Boveri AG, Baden, Switzerland

[21] Appl. No.: 103,491

[22] Filed: Oct. 1, 1987

[30] Foreign Application Priority Data

Oct. 3, 1986 [CH] Switzerland ..... 3968/86

[51] Int. Cl.[5] ..... G06F 12/08; G06F 15/16; G06F 13/00

[52] U.S. Cl. ..... 364/200; 364/243.41

[58] Field of Search ..... 364/200, 900

[56] References Cited

U.S. PATENT DOCUMENTS 3,735,360 5/1973 Anderson et al. ..... 364/200
3,845,474 10/1974 Lange et al. ..... 364/200
3,967,247 6/1976 Anderson et al. ..... 364/200
4,442,487 4/1984 Fletcher et al. ..... 364/200

FOREIGN PATENT DOCUMENTS 0149355 7/1985 European Pat. Off. .

*Primary Examiner*—David Y. Eng
*Attorney, Agent, or Firm*—Burns, Doane, Swecker & Mathis

[57] ABSTRACT

In such a multiprocessor, in which the common memory (M) or one of the cache memories (C1, C2) can be owner of a variable determined by its address and in which it is always only the owner of a variable which delivers it to the bus (1) following a read request, the concept of ownership is further developed by the present invention with respect to implementing it with standard buses which, per se, are not intended for this purpose, and with respect to the greatest possible efficiency.

6 Claims, 2 Drawing Sheets

MULTIPROCESSOR SYSTEM WITH SEVERAL PROCESSORS EQUIPPED WITH CACHE MEMORIES AND WITH A COMMON MEMORY

TECHNICAL FIELD

The present invention relates to a multiprocessor with several processors equipped with cache memories and with a common memory.

PRIOR ART

A multiprocessor of the type initially mentioned is known from a contribution by S. Frank "Tightly Coupled Multiprocessor System Speeds Memory Access Time", Electronics, Jan. 12, 1984, pp. 164–169. The known multiprocessor has a commom memory which is subdivided into so-called "quadwords" of 16 bytes each. Each "quadword" is associated with one address. The "quadword" is the smallest unit with respect to a data transfer in the multiprocessor.

To reduce access time and bus traffic, the processors are in each case equipped with a cache memory which is inserted between the processing unit (CPU) and a common bus.

These cache memories contain copies of frequently used "quadwords", the originals of which are conceptually located in the common memory.

Since, however, the local copies can be changed without updating the original, a copy may under certain circumstances become an original and vice versa. The unit, be it the common memory or cache memory, which contains the reference copy valid in each case is called the owner of the "quadwords". According to definition, the owner of a "quadword" in each case has its correct valid value and must also supply it if this value is requested.

In the known multiprocessor, each "quadword" can either be of the so-called public usage mode or so-called private usage mode. If the usage mode of a "quadword" is public, the common memory is the owner of this "quadword": other units such as the cache memories of the multiprocessor can only have copies of this public "quadword", but all with a valid value. Public "quadwords" may not be changed. The usage mode of a "quadword" can only be private in one of the cache memories of the multiprocessor. The respective cache memory is also the owner of the private "quadword". The "quadword" may be changed only in this cache memory.

Special instructions are provided for transferring the "quadwords" within the known multiprocessor. Public "quadwords" can be read or copied from the common memory into a cache memory with a "read public" instruction; however, the ownership over the "quadword" read remains with the common memory. A "quadword" read with "read public" into a cache memory may not be changed in this memory. In order to be able to change a "quadword" in one of the cache memories, it must first be read into the respective cache memory by a "read private" instruction and by this means privatized. In addition, all units of the known multiprocessor observe the activity on the bus. If one of the cache memories reads a "quadword" with "read private", this is registered by the other cache memories which then in each case mark their copy of the corresponding "quadword" as invalid in themselves.

In the case of the known multiprocessor, the owner of a "quadword" must in each case deliver it to the bus following a read requested of a non-owner. If the common memory is not the owner of the requested "quadword", it ignores the read request. In the common memory, an additional mode bit is provided for each "quadword" which identifies the common memory as owner or non-owner of the respective "quadword".

When a "quadword" is displaced from one of the cache memories in the known multiprocessor, this is done by means of "write modified" or "write unmodified" instructions depending on whether the displaced "quadword" was modified or not. Both the current value of the "quadword" and the ownership over it is transferred into the common memory with the "write modified" instruction. In the case of the "write unmodified" instruction, only the ownership is passed to the common memory since this always still contains the original "quadword". Even though the processor has exclusively requested this "quadword", it was not used for the purpose of modifying it but possibly for executing an indivisible operation.

Finally, a "write new data" instruction is also known in the known multiprocessor, by means of which instruction an I/O device can directly modify "quadwords" in the common memory without first having to privatize these "quadwords" for itself with "read private". The I/O device "steals" with the said instruction the ownership over the "quadwords" which it wants to modify from their respective owners and subsequently transfers them to the common memory. Following such an instruction, all copies of the "quadwords" concerned in the cache memories are marked as invalid.

The special instructions required for data transfer in the known multiprocessor require the use of a bus which is specially designed for these instructions. The instructions described are not supported by standard buses of the type currently used, such as, for example, the VME bus (VME Bus Specifications Rev. C, 850703 4822 873 300 70 Philips Export B.V., Eindhoven, 1985 or the Multibus II (Multibus is a trademark of the company INTEL Corp., US) and is described, for example, in Multibus II Architecture Specification Handbook, Intel Corp., Order No. 146077-C/1984. In addition, they are not at all intended for operation with cache memories since they provide poor support for, for example, the simultaneous transmission of data to several receivers. The known solution involving the special instructions for the transfer of data via the bus is also not software transparent. Thus, for example, the programmer who writes the program for the processors of the known multiprocessor must know in advance and distinguish whether a "quadword" is to be transferred into the associated cache memory only for reading by a processor or whether it is also to be modified there by the processor, possibly very much later. Further examples of lacking software transparency can be easily given. Finally, the processing speed is not optimum in the known multiprocessor. All bus cycles only required for transferring ownership over a "quadword" reduce the processing speed. For example, such a bus cycle is always connected with the "write unmodified" instruction.

SUMMARY OF THE INVENTION

The present invention has the object of specifying a multiprocessor of the type initially mentioned in which, in particular, instructions such as have been described above are not required and which can also operate with commercially available standard buses.

In addition, the present invention has the object of specifying a multiprocessor of the type initially mentioned which is fully software transparent.

The invention also has the object of specifying a multiprocessor of the type initially mentioned which only requires two bits per cache input.

Finally, the present invention has the object of specifying a multiprocessor of the type initially mentioned which is optimized with respect to its processing speed.

The multiprocessor according to the invention can be implemented by using standard buses which are currently used. No special design of the bus is required for supporting special instructions. The multiprocessor according to the present invention, in addition, ensures full software transparency. The multiprocessor according to the invention is also optimized with respect to its processing speed. No bus cycles used only for transferring the ownership over a variable are required. The multiprocessor according to the present invention is therefore particularly suitable for use at levels close to the process in control engineering. The high processing speed of modern processors can be fully utilized in the multiprocessor according to the invention.

DESCRIPTION OF THE PREFERRED EMBODIMENT

Reference will now be made to the drawings. All figures show a multiprocessor which exhibits at a bus B a common memory M, a first processor P1, a second processor P2 and an I/O device I/O. The processors P1 and P2 are in each case equipped with a cache memory and are connected via this memory to the bus B. The cache memory designated by C1 belongs to the first processor P1 and the cache memory designated by C2 belongs to the processor P2.

Within the common memory M a memory area SM for a variable is shown and next to this memory area a first bit B1. If the value of this first bit=1, this is intended to mean that the common memory M is the owner of the variables stored in its memory area SM. If, in contrast, the value of this first bit B1 is=0, this is intended to mean that the common memory M is not the owner of the variables stored in its memory area SM.

Similarly, a memory area is in each case shown in cache memories C1 and C2 for a variable which is designated by SC1 and SC2, respectively. Next to these memory areas SC1 and SC2, a second bit B2 and third bit B3 is in each case also shown in the cache memories C1 and C2. In combination with one another, these bits B2 and B3 are intended to have the following four meanings, depending on their values, with respect to the variables in the memory areas SC1 and SC2, respectively:

| | |
|---|---|
| B2 = 0, B3 = 0 | no valid value<br>write on modification |
| B2 = 0, B3 = 1 | no ownership<br>valid value<br>write on modification<br>no write on displacement |
| B2 = 1, B3 = 0 | ownership<br>valid value<br>write on modification<br>write on displacement |
| B2 = 1, B3 = 1 | ownership<br>valid value<br>no write on modification<br>write on displacement |

In the text which follows, it is assumed that the common memory M and the cache memories C1 and C2 in each case have a logic which is capable of controlling the bits B1 or B2 and B3 and influencing their value in a suitable manner. The operation of these logic arrangements can be seen in the description following.

Figure 1:
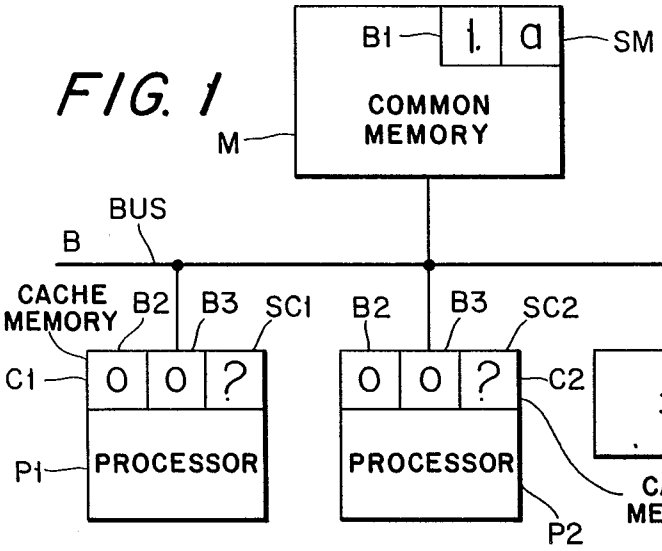
FIGS. 1–8 show the same processor having status bits B1, B2 and B3 in different states.

In FIG. 1, the multiprocessor is shown in a state in which a variable having a value a is only stored in the common memory M, namely in the memory area SM. The common memory M is also intended to be the owner of this variable. The first bit B1 identifying this ownership is correspondingly=1. The two cache memories C1 and C2 are not intended to have a valid copy of this variable, at least not in their memory areas SC1 and SC2. Let the state of the two memory areas SC1 and SC2 initially be undefined. The two bits B2 and B3 are therefore in each case=0.

Now processor P1, for example, shall require the said variable. For this purpose it is requested by means of a conventional read request from the cache memory C1 associated with processor P1 via the bus B. The read request is marked by the arrow 1 in FIG. 2. Following the read request, the common memory M supplies the value a of the variable under consideration via bus B to the cache memory C1. This is illustrated by the arrow 2 in FIG. 2. The resultant state of the multiprocessor can also be seen in FIG. 2. The variable under consideration is still contained in the memory area SM of the common memory M. The common memory M is also still the owner of this variable (B1=1). The ownership over a variable is not lost by a read request. In addition, however, the variable under consideration is now also contained in the memory area SC1 of the cache memory C1. Bits B2 and B3 associated with SC1 identify it (with B2=0 and B3=1) as a valid copy over which, however, there is no ownership.

Figure 2:
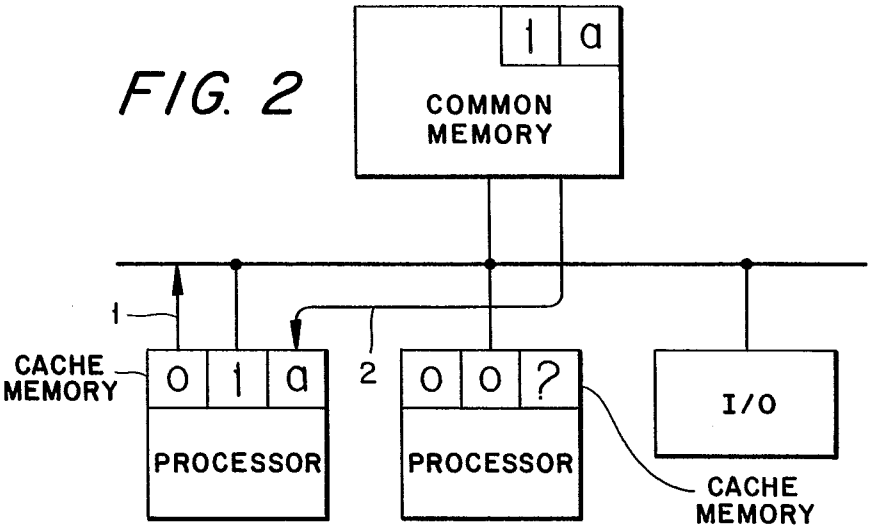

The variable under consideration can now be read by processor P1 from the cache memory C1 as many times as required without any changes occurring in the state of the multiprocessor according to FIG. 2.

Figure 3:
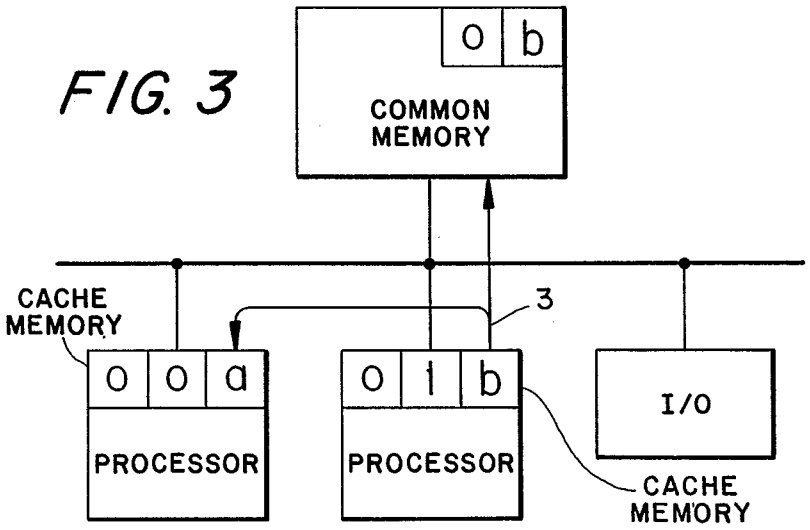

However, the variable under consideration can also be modified as required to the cache memories C1 or C2 by the processors P1 or P2. Referring to FIG. 3, it is assumed, for example, that processor P2 "modifies" the variable under consideration in its cache memory C2 by allocating to it a new value b. This value allocation also does not make the cache memory C2 the owner of this variable. The bits B2 and B3 associated with SC2 newly become B2=0, B3=1. To inform the common memory M and the further cache memory C1 about the modification of the variable under consideration, it, or its new value b, is written into the common memory M by the cache memory C2 via the bus B (arrow 3). This writing, as generally any writing, causes the common memory M to lose its ownership over the written variable (B1=0). The cache memory C1 also registers this write process, identifies the variable written by means of its address and marks it as invalid if it also has a copy of this variable as is assumed here (by resetting bits B2 and B3 to 0). The result is the state of the multiprocessor shown in FIG. 3. It should be noted here that the writing process explained also will have caused the cache memory C2 to lose its ownership over the variable under consideration if, instead of the common memory M, the variable had been in its possession.

Figure 4:
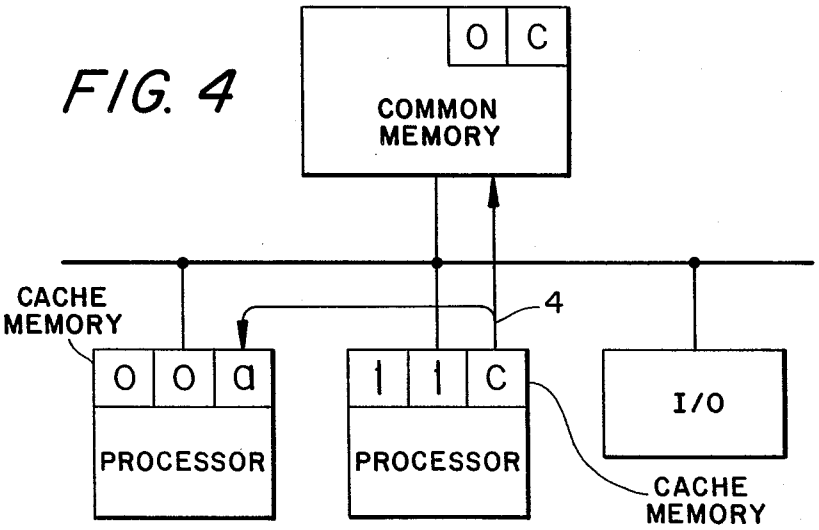

Referring to FIG. 4, it is assumed that processor P2 modifies the variable under consideration again by allocating it a value c. In contrast to modifying a variable which did not have a valid value before its modification, modifying a variable by means of a valid value gives ownership over this variable. (The bits B2 and B3 associated with SC2 in each case again become=1.) This modification, too, as in any case any modification of a variable over which there was no ownership before its modification, is notified to the common memory M and the other cache memory C1 by a write process (arrow 4).

Figure 5:
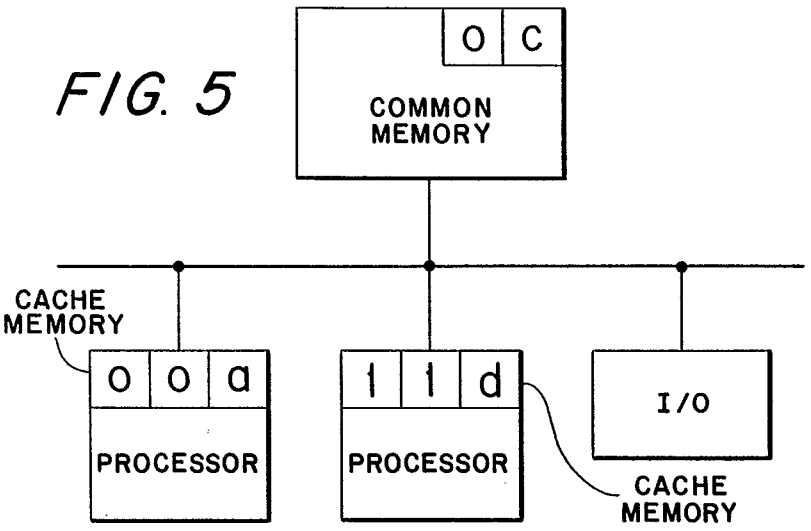

Referring to FIG. 5, it is assumed that processor P2 again modifies the variable under consideration by allocating to it a value d. In contrast to modifying a variable over which there was no previous ownership, modification of a variable over which ownership already existed before its modification, is no longer notified to the common memory M and the other cache memory C1 by a write process, apart from an exception which will still be explained below. As a result, the cache memory C2 is now the only owner and also owner of the valid value d of the variable under consideration.

Figure 6:
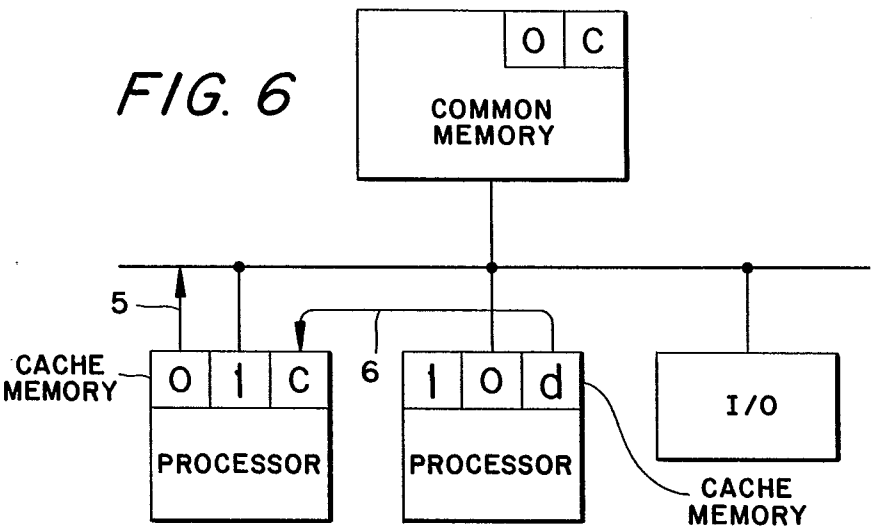

If then, for example, as assumed in FIG. 6, the processor P1 again requires the variable under consideration, its associated cache memory C1 first finds by means of bits B2 and B3 that it no longer has a valid version of this variable. In consequence, it will again request the variable under consideration by a read request via the bus (arrow 5). The variable requested by a read request is always supplied by its owner. In the assumed example, this is the cache memory C2 which currently is also the only owner of the current value d of the variable under consideration (arrow 6). The common memory M ignores the read request of the cache memory C1 since it determines by means of its bit B1 that it is not the owner of the request variable.

Figure 7:
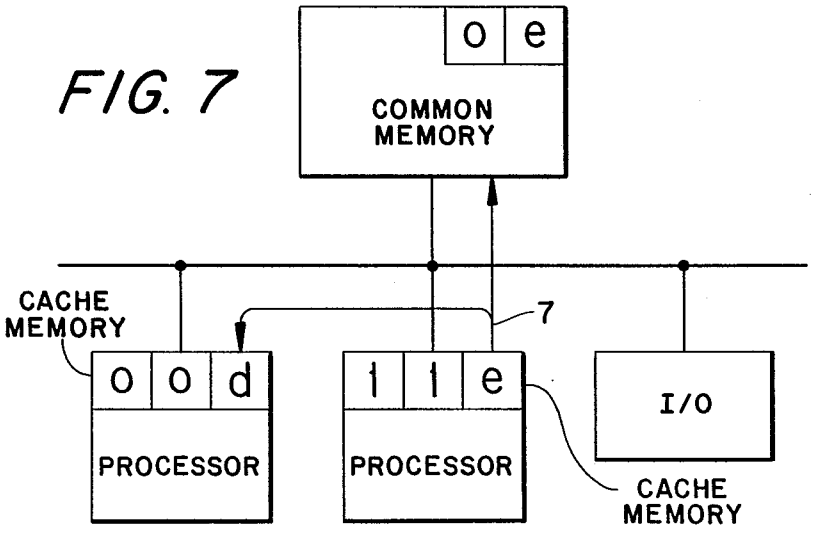

The read process described does not cause the cache memory C2 to lose its ownership over the variable read. It remains the owner of the variable but marks it as "read" by setting bit B3 associated with SC2 to=0. The result is the state of FIG. 6. In this state, the next modification of the variable in the cache memory C2 by processor P2 must be connected with a write process even though the cache memory C2 has ownership over it. This is the aforementioned exception. In FIG. 7, this case is assumed by having the value e allocated this new value to the variable in SC2 by processor P2 and subsequently having this value written into the common memory M via the bus B. The write process is therefore required in order to inform the cache memory C1, which first read the variable and is convinced of possessing the valid value of the variable, about its new modification. Following the write process, the cache memory C1 will mark the previously read value d of the variable as invalid by setting the bits B2 and B3 associated with SC1 in each case to=0. In the cache memory C2, the corresponding bits associated with SC2 again both become=1. Thereafter, the variable in SC2 can again be modified by processor P2 as required without a write process being required.

Figure 8:
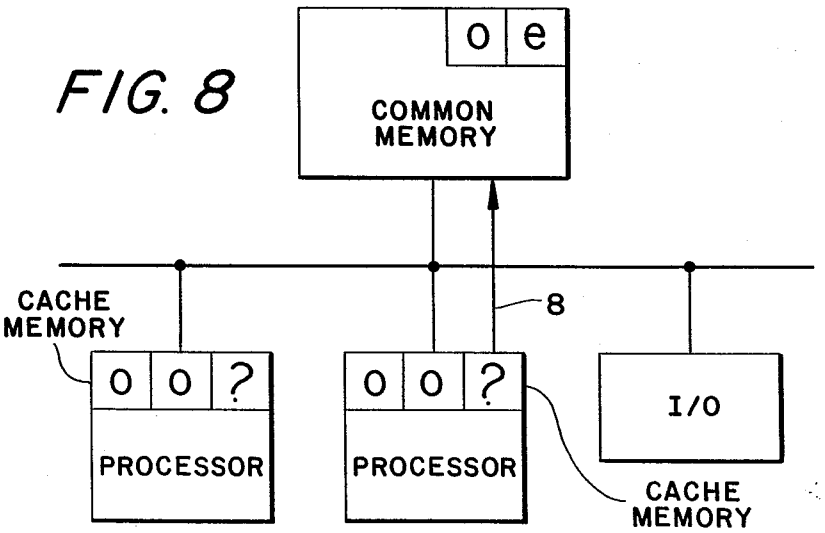

Referring to FIG. 8, the displacement of variables from the cache memories will now be discussed. Compared with the common memory, the cache memories always have a smaller memory capacity. If all storage areas available in the cache memories are occupied with variables and an additional variable is needed which is not yet contained in the cache memory, another variable must be displaced from the cache memory in order to create space for the new variable. Various strategies for selecting the variables are known which are affected by the displacement in the respective case. Initially, it will now be assumed that the variable, already previously continuously considered, in the memory area SC1 of the cache memory C1 just happens to be affected by the displacement. According to the state last reached, the cache memory C1 no longer has a valid value of this variable. Variables without valid value can be simply displaced and replaced by a new variable.

The variable under consideration is now also to be displaced from the cache memory C2. According to the state last reached, the cache memory C2 has the ownership over this variable. When a variable is displaced from a cache memory which has the ownership over the variable and thus also always its valid value, a write process into the common memory M is always required in order to ensure that its current value is not lost. Starting from the state shown in FIG. 7, such a write process would not be required per se since the common memory is already in possession of the current value e of the variable. However, for the case that the displacement from SC2 would already be required in a state as is shown in FIG. 5 or also in FIG. 6 in which the common memory M was not in possession of the current value of the variable, its current value would have been lost without the required write process. Thus, in the current example, the cache memory C2 will write the variable under consideration with its current value e into the common memory M (arrow 8 in FIG. 8). After the writing, the cache memory C2 marks the value of the variable in its memory area SC2 as invalid by setting the bits B2 and B3 associated with SC2 to =0. After that, the memory area SC2, as previously the memory area SC1 in the cache memory C1, is available for receiving a new variable. Finally, the state shown in FIG. 8 is obtained.

It should be mentioned at this point that the displacement of a variable with a valid value over which, however, there is no ownership, does not require an additional write process since the valid value of the variable must always exist at least once in the multiprocessor either in the common memory M or in a cache memory. As a consequence of the displacement assumed in explanation of FIG. 8, the cache memory C2 has lost its ownership over the displaced variable without this ownership simultaneously having been transferred to one of the other memories of the multiprocessor. There is therefore no longer an owner over the said variable in the state of the multiprocessor as is shown in FIG. 8.

If then, in the state of FIG. 8, the variable under consideration is requested by a read request, the question arises as to which of the memories will respond to this read request. Let it be assumed, for example, that the I/O device I/O requests the variable under consideration in each case for reading. As defined above, a variable is always only supplied by its owner. If there is no owner as in the case which happens to be under consideration, one of the memories must newly take over ownership. In each case, this is the responsibility of the common memory M; this is because the common memory M always contains a valid copy whenever the ownership over a variable is lost.

The common memory M can, for example, always take over ownership over a variable when, following a read request for the variable, none of the cache memories has supplied this variable to the bus before a predeterminable period of time has elapsed after the read request (timeout method).

The common memory M could also "keep book" about the state of the cache memories in a special logic. Using this bookkeeping, it could determine in each case whether ownership exists over a particular variable in a cache memory. If this is not the case and it is not owner itself, it would have to take over ownership of the variable.

Loss of the ownership over a particular variable could also be avoided via a bus line specially provided for this purpose and a suitable bus signal on this bus line. A bus line suitable for this purpose is also available in most of the standard buses. For example, the top bit of address can be used for this purpose. Via the said bus line, it would have to be signalled to the common memory M whether it should retain or newly take over the ownership of the variable during a process of writing into it. During the writing explained with the aid of FIG. 3, it would have to retain it. During the writing in the case of displacement of a variable it would have to take it over.

In the multiprocessor according to the invention, there are two other cases in which ownership over a variable is lost. One of these occurs on modification of a variable marked as invalid before its modification and the write process connected with it. Incidently, this case occurs in FIG. 3. The other one of these cases is modification of a variable in the common memory by a write process executed by the I/O device I/O. Such a write process causes the common memory M, or also one of the cache memories to lose ownership over the variable concerned by the write process without this ownership being taken over by the I/O device. Such ownership is not provided in standard I/O devices which are predominantly to be used in the multiprocessor according to the invention. Recovery of ownership can also take place in these two cases in accordance with one of the three above-mentioned methods.

The common memory M can also be designed in such a manner that it is capable of tracking the activity on the bus B in order to update the transferred variable in itself whenever a variable is transferred from a cache memory via the bus B following a read request of another cache memory or also of the I/O device. For this purpose, the common memory M must interpret read accesses to a variable of which it is not the owner as write accesses to itself. Such a design of the common memory obviates the writing during displacement of a variable marked as "read" (B2=1, B3=0) from a cache memory.

The subject matter of the illustrative embodiment explained above was a multiprocessor having only two processors, two associated cache memories and only one I/O device. It was restricted to this low number of components for reasons of a simpler and more understandable explanation. Naturally the invention can also be applied in the case of multiprocessors having considerably more components. The advantages according to the invention are only fully effective specifically with a relatively large number of processors.

I claim:

1. A multiprocessor system comprising:

a plurality of processors, each of said plurality of processors being equipped with an associated cache memory, a common memory, said common memory and each of said cache memories adapted to store at least one variable in accordance with address information associated with said variable;

a bus which connects said processors and said common memory, said common memory or one of said cache memories being owner of a variable determined by the address of said variable, only said owner delivering a variable to said bus following a read request, each of said processors including means for modifying the variable present in the associated cache memory, a cache memory in which a variable having a valid value is stored becoming owner of the variable when said variable is modified by the associated processor, means for writing a modified value of a variable into said common memory for each modification of said variable in said cache memory when said cache memory was not owner of the variable before modification or when said cache memory was owner but which variable was delivered by said cache memory to said bus before modification, said common memory or one of said cache memories losing ownership over the written variable during said writing, means for marking said variable as invalid in all said cache memories except in a cache memory from which said variable is being written, during each writing of a variable through the bus into said common memory, said writing means operative during displacement of a variable from a cache memory which has ownership of said variable to write said variable into said common memory through said bus, said common memory assuming ownership of said variable during displacement of the variable from said cache memory which has ownership over the variable, said common memory including a first memory bit for each variable, said first memory bit specifying whether said common memory is owner of the respective variable, each of said cache memories including a second memory bit and a third memory bit for each variable which, in combination with one another, specify the operating state of the variable, possible operating states including:

(a) the associated variable has an invalid value and a write process into said common memory is required on modification of said associated variable, (b) the associated variable has a valid value but the respective cache memory is not owner of the variable and a write process into said common memory is required on modification of the variable but not on displacement of the variable, (c) the associated variable has a respective value, the respective cache memory is owner of this variable and a write process into said common memory is required on modification of the variable and on displacement of the variable, and (d) the associated variable has a valid value, the respective cache memory is owner of this variable and a write process into said common memory is required only on displacement of said variable.

2. Multiprocessor system according to claim 1, wherein the common memory, on each read request of a variable of which the common memory is not the owner, assumes ownership of said variable unless one of the cache memories has delivered the variable to said bus within a predetermined period of time after the read request.

3. Multiprocessor system according to claim 1, wherein the common memory includes logic for keeping book about the state of the cache memories and for determining by means of this bookkeeping whether ownership over a particular variable exists in one of the cache memories and said common memory assumes ownership over the variable if ownership over the particular variable does not exist in one of the cache memories.

4. Multiprocessor system according to claim 1, wherein a separate bus line is provided, said separate bus line being connected to the cache memories, said cache memories signalling to the common memory via said separate bus line whether said common memory should take over or retain or relinquish ownership over the variable written during a write process in said common memory.

5. Multiprocessor system according to claim 4, further including an I/O device connected to said bus, said separate bus line being utilized by said I/O device such that a writing of a variable by the I/O device via the bus into the common memory corresponds to the writing of a variable by the cache memory and the common memory therefore assumes or retains ownership over this variable during the writing of a variable by the I/O device.

6. Multiprocessor system according to claim 1, wherein the common memory interprets all read requests of variables of which said common memory is not the owner as writing of the variable and updates the value of the variable by the value transferred via the bus and wherein there is no writing into said common memory on displacement of a variable from one of the cache memories which was read from another cache memory directly before displacement of said variable.

* * * * *